United States Patent [19]

Gordon

[11] Patent Number: 4,716,394

[45] Date of Patent: Dec. 29, 1987

[54] BOBBIN DEVICE

[75] Inventor: Albert Gordon, Beachwood, Ohio

[73] Assignee: Cosmo Plastics Company, Cleveland, Ohio

[21] Appl. No.: 25,067

[22] Filed: Mar. 12, 1987

[51] Int. Cl.[4] ..... H01F 27/30

[52] U.S. Cl. ..... 336/192; 242/118.41; 336/198

[58] Field of Search ..... 242/118.41; 336/198, 336/208, 192; 310/194

[56] References Cited

U.S. PATENT DOCUMENTS 4,250,479 2/1981 Bausch et al. ..... 336/208

*Primary Examiner*—Thomas J. Kozma

*Attorney, Agent, or Firm*—Pearne, Gordon, McCoy & Granger

[57] ABSTRACT

A transformer bobbin assembly comprising a U-shaped shroud having a pair of bobbins removably mounted therein. In order to assure reliable assembly, the bobbins include detents to indicate proper positioning with respect to each other and cooperatively provide mounting channels for receipt of an intermediate rib and spaced leg guides extending transversely inwardly from the shroud.

11 Claims, 6 Drawing Figures

BOBBIN DEVICE

BACKGROUND OF THE INVENTION AND PRIOR ART

This invention relates to transformer coil bodies, and more particularly, to a transformer coil assembly.

The transformer coil assemblies of interest herein have axially separated winding areas and are typically provided with one or a plurality of coil body or bobbin members which provide coil winding areas. Generally, the bobbin has a core of rectangular cross-section but other cross-sectional shapes such as round or square may be used. Axially spaced flanges extend radially outwardly from the core to define the coil winding areas. The bobbin or bobbins are mounted in a housing or shroud. The bobbin and shroud members are generally formed of molded plastic material which is non-conductive.

The possibility of electrical failure due to the formation of a small electric arc or creep path between adjacent coils has prompted the adoption of standards regarding the length of the minimum creep path. These standards have resulted in the use of the flanges and cooperating insulators to define serpentine or tortuous paths which meet minimum creep path length requirements. For example, U.S. Pat. No. 3,750,072 discloses the use of an insulating frame having an annular sleeve for receiving the flanges of a bobbin and an inwardly projecting annular wall which cooperates with the sleeve to define tortuous creep paths between adjacent coils. The bobbins and frame member are joined in an assembly by entrapment of a further overlying sleeve with a pair of end caps or a pair of side shields. This transformer arrangement requires axial assembly of the bobbins and simultaneous positioning of several pieces prior to joining of the assembly components.

In order to eliminate the manipulation of separate bobbin members during manufacture and/or reduce the total number of parts, one piece bobbin members having axially spaced winding areas separated by flanges are disclosed in U.S. Pat. Nos. 3,909,761 and 4,405,913. In each of these patent teachings, the flanges are provided with grooves in their edges for receiving an insulator extension projecting from an overlying cap member in order to provide a serpentine creep path between the adjacent winding areas. Although the use of a one-piece bobbin reduces the total number of parts and facilitates manipulation during assembly, it does give rise to a tendency of inner flange distortion during winding since it cannot be supported as in the case of separate bobbins. Also, the use of a single bobbin for primary and secondary windings tends to impose greater inventory demands and to limit flexibility of product types for a given inventory.

SUMMARY OF THE INVENTION

An improved transformer coil assembly is provided with a housing or shroud to removably mount a pair of bobbins. The shroud and bobbins include interengaging surfaces which assure proper positioning of the bobbins with respect to each other and to the shroud in order to provide reliable assembly.

The shroud is sized to resiliently captively engage the bobbins when they are axially and angularly aligned in a sub-assembly for insertion into the shroud upon proper assembly. The shroud resists the insertion assembly of improperly positioned bobbins with resilient forces of sufficiently increased magnitude to be detected by hand-manipulation or automatic assembly techniques.

In accordance with the invention, the shroud has a U-shaped configuration including axially spaced legs joined by a bight. Each bobbin has a core extending between axially spaced mating and end flanges. The mating flanges of axially aligned bobbins are enagaged, and the bobbins are assembled in the shroud by transverse movement through the open side of the U-shaped configuration. The bight and legs of the shroud are spaced from the axis of the assembly and, typically, the open side of the shroud is located at the base of the transformer coil assembly.

The interengaging surfaces include detents provided by the mating flanges to index the bobbins together and mounting channels provided by the bobbins for receipt of shroud engaging portions to assure proper positioning of the bobbins with respect to the shroud. An axially intermediately located mounting channel is cooperatively defined by the mating flanges to receive a mounting rib provided along the interior surface of the shroud. The end flanges provide axially outboard mounting channels for engagement with the shroud legs.

The shroud engaging portions and the mounting channels also cooperate to provide creep paths of increased lengths adjacent specific locations in the assembly in order to meet applicable standards. The mounting rib cooperates with the intermediate mounting channel surfaces and adjacent flange surfaces to provide a creep path of the necessary length between adjacent bobbins around a major portion of the periphery of the assembly. The lateral dimensions of the flanges extending along the remaining portion of the periphery of the assembly are of a relatively increased size to provide the required creep path length. The outboard mounting channels are provided adjacent a terminal support and receive adjacent portions of the shroud legs to provide increased creep path lengths between the winding of the adjacent bobbin and the terminal support.

DETAILED DESCRIPTION OF THE DRAWINGS

Figure 1:
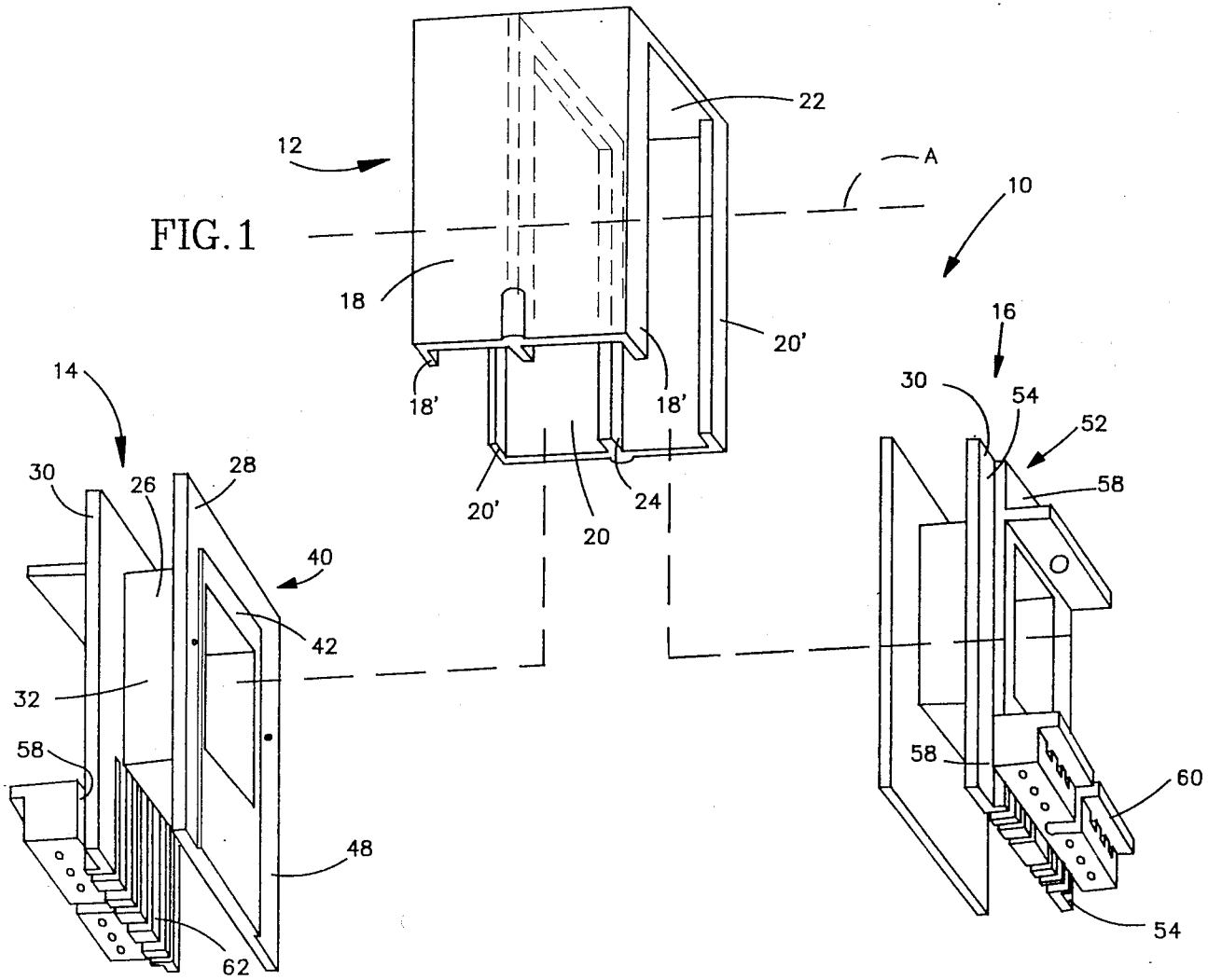
FIG. 1 is an exploded perspective view of a transformer coil assembly including a shroud and separate bobbins in accordance with the present invention.

Referring to FIG. 1, there is shown a transformer coil assembly 10 comprising a shroud 12 and a pair of identical bobbins 14 and 16. For convenience, the assembly 10 is considered to have an axis A. As described below in greater detail, the bobbins 14, 16 are sized to be received within the shroud 12 with a sliding frictional fit.

The shroud 12 includes laterally spaced legs 18 and 20 which are joined by bight 22. The shroud 12 has an axial length corresponding with that of the assembled bobbins 14 and 16. The legs 18 and 20 are each provided with a pair of transversely inwardly projecting leg guides 18′ and 20′. The shroud 12 also includes a transversely inwardly projecting mounting rib 24. The rib 24 extends around the entire inner periphery of the legs 18, 20 and the bight 22. The rib 24 is located along a plane which axially bisects the shroud 12 for receipt of the bobbins 14, 16 on each side thereof. However, the rib 24 may be non-symmetrically positioned for use with bobbins that have different axial dimensions.

The bobbins 14 and 16 are identical as indicated above. For convenience, only the bobbin 14 is discussed in detail. The bobbin 14 has a core 26 which extends axially between a mating flange 28 and an end flange 30. The core 26 is provided with a rectangular configuration, but other shapes may be used. As is well known in the art, the transformer core itself may comprise a laminate stack of metal plates or ferrite cores, generally E-shaped. The metal plates are stacked with the middle bar of the E extending through the core 26 and the outer bars of the E located adjacent the periphery of the flanges 28 and 30. Alternate metal plates may extend from opposite axial ends of the transformer assembly. A coil winding area 32 is provided by the core 26 and the flanges 28, 30.

The mating flange 28 has a mating face 40 remote of the coil winding area 32. The mating face 40 includes an interior planar surface portion 42 which surrounds the opening defined by the core 26. The surface portion 42 of the bobbin 14 engages a corresponding surface portion provided by the bobbin 16 when the bobbins are assembled within the shroud 12.

Figure 4:
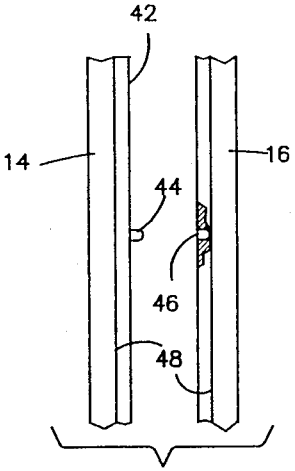
FIG. 4 is a fragmentary sectional view showing the detent members of the bobbins.
Figure 3:
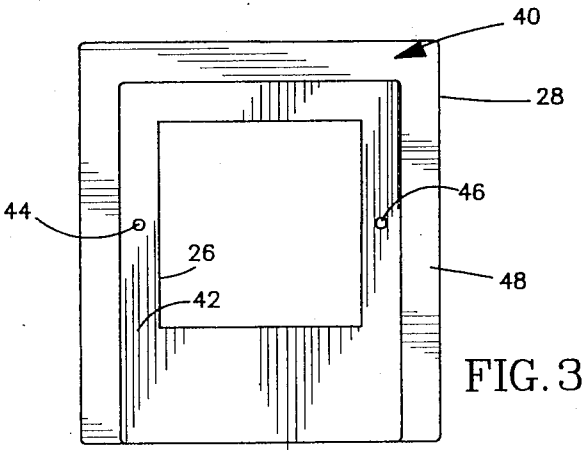
FIG. 3 is a view on an enlarged scale of a mating flange of the bobbin of FIG. 1 as seen from an inboard axial direction.

Referring to FIG. 3, the surface portion 42 includes a detent projection 44 and a detent recess 46. The detents 44, 46 are more clearly shown in FIG. 4 with respect to the bobbins 14 and 16. If the bobbins 14 and 16 are axially and angularly aligned when joined in a subassembly, the detents 44 and 46 operate to permit engagement of the surface portions 42 of the bobbins and positioning of the end flanges at the proper axial spacing for receipt in the shroud 12. If the bobbins are not axially and angularly aligned, the detents 44, 46 do not engage and the bobbins 14 and 16 are spaced apart an increased axial distance.

Figure 2:
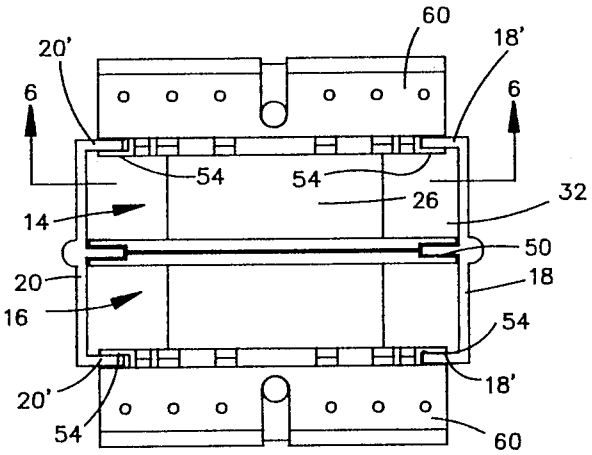
FIG. 2 is a view of the base of the transformer coil assembly of FIG. 1 as seen from below.

The mating face 40 also includes a recessed planar surface portion 48 extending around the periphery of the surface 42 on all sides thereof except for the base. Upon assembly, the surfaces 48 of the bobbins 14 and 16 cooperate to define a mounting channel 50 as best shown in FIG. 2. Upon assembly, the mounting channel 50 receives the rib 24 of the shroud 12.

Figure 5:
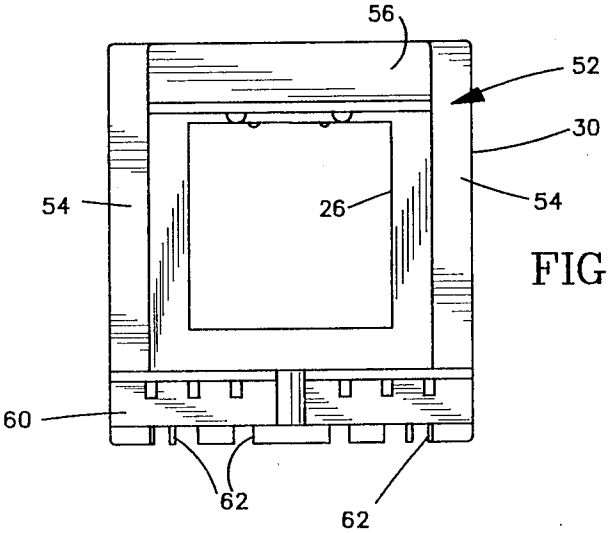
FIG. 5 is a view of a mating flange similar to FIG. 3 as seen from a outboard axial direction.

Referring to FIG. 5, the end flange 30 includes an outboard face 52. The face 52 includes a pair of laterally outwardly spaced slide mounting surface 54 and an interior planar surface portion 56. The surfaces 54 are recessed relative to the surface portion 56 and the remainder of the face 52. Upon assembly, the surfaces 54 engage the leg guides 18′ and 20′. The leg guides cooperate to axially capture and entrap the assembled bobbins 14 and 16.

A terminal support 60 extends from the surface 56 of the outboard face 52 adjacent the base of the bobbin assembly 10. The terminal support corresponds in lateral dimension with the face 52 and cooperates therewith to provide outboard mounting channels 58 (FIGS. 1 and 2). The terminal support 60 extends from the surface 56 over the adjacent portions of the mounting surfaces 54 to cooperatively provide the mounting channels 58 for receipt of the leg guides 18′ and 20′. The surfaces 54 are recessed with respect to the surface 56 a distance at least equal to the thickness of the leg guides 18′ and 20′.

Figure 6:
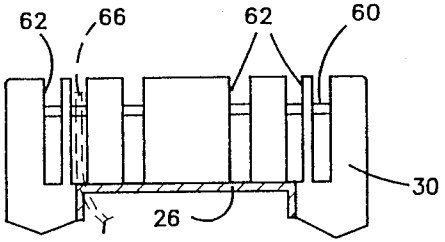
FIG. 6 is a fragmentary sectional view of an end flange taken along the line 6—6 of FIG. 2, with parts omitted and broken away for clarity of illustration.

Referring to FIGS. 5 and 6, a plurality of wiring slots 62 are provided in the end flange 30 adjacent the terminal support 60. The slots 62 are provided for receipt of wire leads extending from the coil winding area 32 for connection to terminal pins (not shown) carried by the terminal support 60. The end flange 30 extends beyond the terminal support 60 so that wire 66 within the slot 62 is located within the overall lateral dimensions of the flange.

Prior to assembly, the bobbins 14 and 16 are separately wound. The mating flanges 28 of the wound bobbins are positioned together and moved to a proper axial alignment and angular orientation in order to engage detents 44 and 46. When properly positioned, the planar surface portions 42 of each of the flanges 28 are engaged. The bobbins 14 and 16 are then moved transversely into the open base end of the shroud 12. The rib 24 is received within the intermediate mounting channel 50 and pairs of leg guides 18′ and 20′ slidingly engage associated surfaces 54 and extend into outboard mounting channels 58. Accordingly, each of the bobbins 14 and 16 are engaged along their mating flanges 28 and their end flanges 30 by the shroud 12 during mounting to assure reliable and correct assembly.

The shroud 12 is sized to slidingly engage the bobbins 14 and 16 during assembly with a predetermined frictional resistance. If the detents 44 and 46 are not properly engaged and thereby increase the axial spacing between the bobbins 14 and 16, the frictional resistance to the assembly of the bobbins is sufficiently increased to be detectable by hand-manipulation as well as automated assembly procedures. If the bobbins 14 and 16 are merely laterally misaligned in the direction of transverse movement, continued movement of the bobbins into engagement with the bight 22 of the shroud 12 will cause a detectable "clicking" engagement of the detents 44 and 46.

In addition to assuring proper assembly, the mounting channels 50, 58 cooperate with the mounting rib 24 and leg guides 18′, 20′ to provide increased creep path distances. The engagement of the rib 24 within the channel 50 adjacent the sides and top of the coil assembly 10 provides a tortuous creep path between the windings of adjacent bobbins 14 and 16 along these three sides of the assembly. The creep path has a length required by applicable standards to avoid electric arc or creep between the windings of bobbins 14 and 16. Adjacent the base side of the assembly 10, the flanges 28 and 30 have increased lateral dimensions, as compared with the other three sides of the flanges, and provide creep paths of the necessary lengths. The outboard mounting channels 58 increase the creep path length between the winding of the adjacent bobbin and its terminal support.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

I claim:

1. A transformer coil assembly comprising a shroud member having a pair of bobbin members removably mounted therein; each of said bobbin members comprising a central core adapted to extend along an axis of the assembly between an end flange and a mating flange, said flanges extending transversely of said core and providing a winding area therebetween, said mating flanges of said bobbin members including mating faces adapted to be disposed in adjacent relationship when said bobbin members are mounted in said shroud member to provide said assembly, said mating faces including first mounting surfaces which engage upon assembly of the bobbin members, second mounting surfaces which cooperate to provide a mounting channel, and interengaging means for indicating axial and angular alignment of the bobbin members in a subassembly position with engagement of said first mounting surfaces and provision of the mounting channel, said end flanges having axially outboard faces including spaced slide mounting surfaces for engagement with said shroud member, said shroud member having a U-shaped configuration including a bight adapted to extend along the top of the assembly between a pair of legs spaced from said assembly axis, said shroud member including a transversely inwardly extending rib located at an intermediate location along its axial length for engagement within said mounting channel, each of said shroud legs including axially spaced transversely inwardly projecting leg guides for engaging one of the slide mounting surfaces on each of said end flanges, said leg guides of each leg being axially spaced by a distance equal to the axial spacing of said end flanges of said bobbin members when said first mounting surfaces are engaged, said shroud member being adapted to receive said bobbin members in said proper subassembly position between the shroud legs in a sliding frictional fit with engagement of said rib within said mounting channel and intermediate rib engagement whereby said bobbin members are reliably assembled upon transverse relative movement within said shroud member with said leg guides engaging said slide mounting surfaces and axially confining said bobbin members within said shroud member.

2. An assembly according to claim 1, wherein said first mounting surfaces are first planar surface portions of said mating faces and said interengaging means are adapted to axially space said first planar surface portions if said bobbin members are not axially and angularly aligned with each other.

3. An assembly according to claim 2, wherein said second mounting surfaces are second planar surface portions of said mating faces, each of said second planar surface portions being recessed from said first planar surface portion and extending about at least a portion of the periphery of said first planar portions.

4. An assembly according to claim 3, wherein said interenaging means comprise a pair of detents located adjacent said first planar surface portions, each detent including a projection and a recess.

5. An assembly according to claim 4, wherein said shroud is sized to resiliently bias said mating flanges axially together with a predetermined force so that spacing of said first planar surface portions by said interengaging means if said bobbin members are not properly axially and angularly aligned results in an increased biasing force which is reduced upon movement of the bobbin members to said proper subassembly position, said increased biasing force being detectable by hand-manipulation of the bobbin members.

6. An assembly according to claim 5, wherein a terminal support extends from said outboard face of said end flange between said spaced slide mounting surfaces and over opposed portions thereof to provide second mounting channels for receiving said leg guides of said shroud legs.

7. An assembly according to claim 6, wherein said first mentioned mounting channel and intermediate rib cooperate to provide a tortuous creep path between said winding areas of said bobbin members and said second mounting channel and leg guide cooperate to provide a tortuous creep path between said terminal support and winding area of an adjacent bobbin member in said transformer assembly.

8. An assembly according to claim 7, wherein said first planar surface portion extends about said core of said bobbin member and extends to the outer extremity of said mounting flange adjacent at least one side of the core.

9. An assembly according to claim 8, wherein said end flange includes slots for electrical wires extending from said winding area to said terminal support.

10. An assembly according to claim 9, wherein said core has a rectangular-shaped cross-section and said flanges project therefrom with a rectangular configuration.

11. An assembly according to claim 1, wherein said end flange includes a plurality of second mounting channels for receiving said leg guides.

* * * * *